US007607565B2

(12) United States Patent
Noguchi

(10) Patent No.: US 7,607,565 B2
(45) Date of Patent: Oct. 27, 2009

(54) PACKAGE BOX

(75) Inventor: Yasuhiro Noguchi, Saitama-ken (JP)

(73) Assignee: FUJIFILM Corporation, Tokyo (JP)

( * ) Notice: Subject to any disclaimer, the term of this patent is extended or adjusted under 35 U.S.C. 154(b) by 708 days.

(21) Appl. No.: 11/064,938

(22) Filed: Feb. 25, 2005

(65) Prior Publication Data

US 2005/0191900 A1 Sep. 1, 2005

(30) Foreign Application Priority Data

Feb. 27, 2004 (JP) ..... 2004-053993

(51) Int. Cl.
*B65D 5/487* (2006.01)
*B65D 85/30* (2006.01)

(52) U.S. Cl. ..... 229/120.13; 206/232; 206/316.2; 229/120.21

(58) Field of Classification Search ..... 229/120.13, 229/120.21, 198.2, 120.18; 206/232, 316.2, 206/722, 723, 784
See application file for complete search history.

(56) References Cited

U.S. PATENT DOCUMENTS 2,231,981 A * 2/1941 Zalkind ..... 229/120.13
2,670,125 A * 2/1954 Frankenstein ..... 206/784
3,361,324 A * 1/1968 Crisafulli ..... 229/120.13
4,026,411 A * 5/1977 Johnson ..... 206/784
4,088,262 A * 5/1978 Kuehlhorn ..... 229/120.13
4,438,848 A * 3/1984 Montealegre et al. .. 229/120.13
4,957,237 A * 9/1990 Madonna et al. ..... 229/120
5,226,588 A * 7/1993 Schramm et al. ..... 229/149
5,908,153 A * 6/1999 Greer et al. ..... 229/198.2
6,095,408 A * 8/2000 Nguyen ..... 229/120.21

FOREIGN PATENT DOCUMENTS

JP 60-33012 U 3/1985
JP 05-010225 U 2/1993
JP 2000-142672 A 5/2000
JP 3272054 B2 1/2002
JP 2003-200975 A 7/2003

* cited by examiner

*Primary Examiner*—Gary E Elkins
(74) *Attorney, Agent, or Firm*—Sughrue Mion, PLLC

(57) ABSTRACT

An interior of the package box is partitioned by an intermediate partition plate into a first accommodation portion and a second accommodation portion. A small partition plate is folded into the package box to form a third accommodation portion. An instruction manual and a device body are accommodated in the first accommodation portion and the second accommodation portion, and a small article and the like are accommodated in the third accommodation portion. The small partition plate is prevented from unfolding open by an edge side of the first connection piece. Therefore, the small article and the like accommodated in the third accommodation portion do not move into the first accommodation portion. The third accommodation portion can be formed by a simple operation (inserting operation is unnecessary) only by folding the small partition plate into the package box.

16 Claims, 11 Drawing Sheets

PACKAGE BOX

CROSS-REFERENCE TO RELATED APPLICATION

This application claims priority under 35 USC 119 from Japanese Patent Application No. 2004-53993, the disclosure of which is incorporated by reference herein.

BACKGROUND OF THE INVENTION

1. Field of the Invention

The present invention relates to a package box, and more particularly, to a package box in which a precision instrument such as a digital camera is packaged.

2. Description of the Related Art

Conventionally, in order to partition an interior of the package box in which a precision instrument such as a digital camera is packaged into plural spaces, a partition plate integrally formed on the box body is used. Printed matters such as an instruction manual and an attachment and the like are accommodated in an upper accommodation space partitioned by the partition plate, and a digital camera is accommodated in a lower accommodation space.

The upper accommodation space is partitioned by a small partition plate to form an accommodation space, and an attachment and the like are accommodated in the accommodation space. The small partition plate is fixed in the box so that the attachment and the like accommodated in the accommodation space do not move in the box.

As one example of the package box, as shown in FIG. 10, a method is disclosed in which an accommodation space of a package box 100 is partitioned by a first tongue piece 102 into an upper accommodation space and a lower accommodation space (see Japanese Patent No. 3272054 (page 4 and FIG. 10)). An insertion piece 106 is continuously connected to a tip end edge of a second tongue piece 104, and the first tongue piece 102 is formed with a slit 108 into which the insertion piece 106 is inserted. The insertion piece 106 of the second tongue piece 104 is inserted into the slit 108. As shown in FIG. 11, an attachment 112 is accommodated in an accommodation space partitioned by the second tongue piece 104, and an instruction manual 110 is placed on the first tongue piece 102.

If this method is used, however, since the insertion piece 106 of the second tongue piece 104 is inserted into the slit 108 of the first tongue piece 102, the size of the first tongue piece 102 must be greater than that of the instruction manual 110, and it is troublesome to insert the insertion piece 106 into the slit 108. Further, the box is increased in size, and this increases the cost of the box.

SUMMARY OF THE INVENTION

The present invention has been accomplished in view of the above fact, and the invention provides a package box that can easily be assembled, and in which it is unnecessary to form a slit in the partition plate, and the entire box can be reduced in size.

A first aspect of the invention provides a package box including: a box body having an opening through which an article to be packaged can be put into and taken out of the box body; a first connection piece which is integrally and continuously connected to one side of the opening and which is folded toward an inner wall of the box body; a partition plate which is integrally and continuously connected to the first connection piece and which partitions an accommodation space surrounded by the box body into an upper first accommodation portion and a lower second accommodation portion when the partition plate is folded into the box body; a second connection piece integrally and continuously connected to another side of the opening which is substantially perpendicular to the one side; a held plate which is integrally and continuously connected to the second connection piece and which is folded toward the inside of the box body such that the first accommodation portion is formed with a third accommodation portion; and an unfolding preventing portion which is provided on the first connection piece and which prevents the held plate folded toward the inside of the box body from unfolding open.

According to the first aspect, the box body has the opening through which the article to be packaged can be put into and taken out of the box body, and the first connection piece is integrally and continuously connected to the one side of the opening. If the first connection piece is folded toward an inner wall of the box body, the partition plate which is integrally and continuously connected to the first connection piece partitions the accommodation space surrounded by the box body into the upper first accommodation portion and the lower second accommodation portion. The second connection piece is integrally and continuously connected to another side of the opening which is perpendicular to the one side of the opening to which the first connection piece is continuously connected. The second connection piece is folded into the box body, and the third accommodation portion is formed in the first accommodation portion by the held plate which is integrally and continuously connected to the second connection piece. The first connection piece is provided with the unfolding preventing portion, and the held plate folded in the box body is prevented from unfolding open.

The interior of the box body is partitioned by the partition plate into the first accommodation portion and the second accommodation portion. The held plate is folded into the box body to form the third accommodation portion. For example, an instruction manual and a device body are accommodated in the first accommodation portion and the second accommodation portion, and a small article and the like are accommodated in the third accommodation portion.

At that time, since the held plate is prevented from unfolding open by the unfolding preventing portion provided on the first connection piece, the small article and the like accommodated in the third accommodation portion do not move into the first accommodation portion. The third accommodation portion can be formed by a simple operation (inserting operation is unnecessary) only by folding the small partition plate into the package box.

When the small article and the like accommodated in the third accommodation portion are to be taken out, it is only necessary to unfold open the held plate, the small article can easily be taken out, and it is easy to handle the package box.

A second aspect of the invention provides a package box including: a box body having an opening through which an article to be packaged can be put into and taken out of the box body; a first connection piece which is integrally and continuously connected to one side of the opening and which is folded toward an inner wall of the box body; a partition plate which is integrally and continuously connected to the first connection piece and which partitions an accommodation space surrounded by the box body into an upper first accommodation portion and a lower second accommodation portion when the partition plate is folded into the box body; a second connection piece integrally and continuously connected to the other side of the opening which is substantially perpendicular to the one side; a held plate which is integrally and continuously connected to the second connection piece and which is folded toward the inside of the box body such that the first accommodation portion is formed with a third accommodation portion; and an unfolding preventing portion which is provided on an edge of the first connection piece nearest to the second connection piece, and which prevents the held plate folded toward the inside of the box body from unfolding open.

Since the invention has the above structure, it is unnecessary to form a slit in the partition plate, and the entire box can be reduced in size, and it becomes easy to assemble the box.

DETAILED DESCRIPTION OF THE INVENTION

Figure 1:
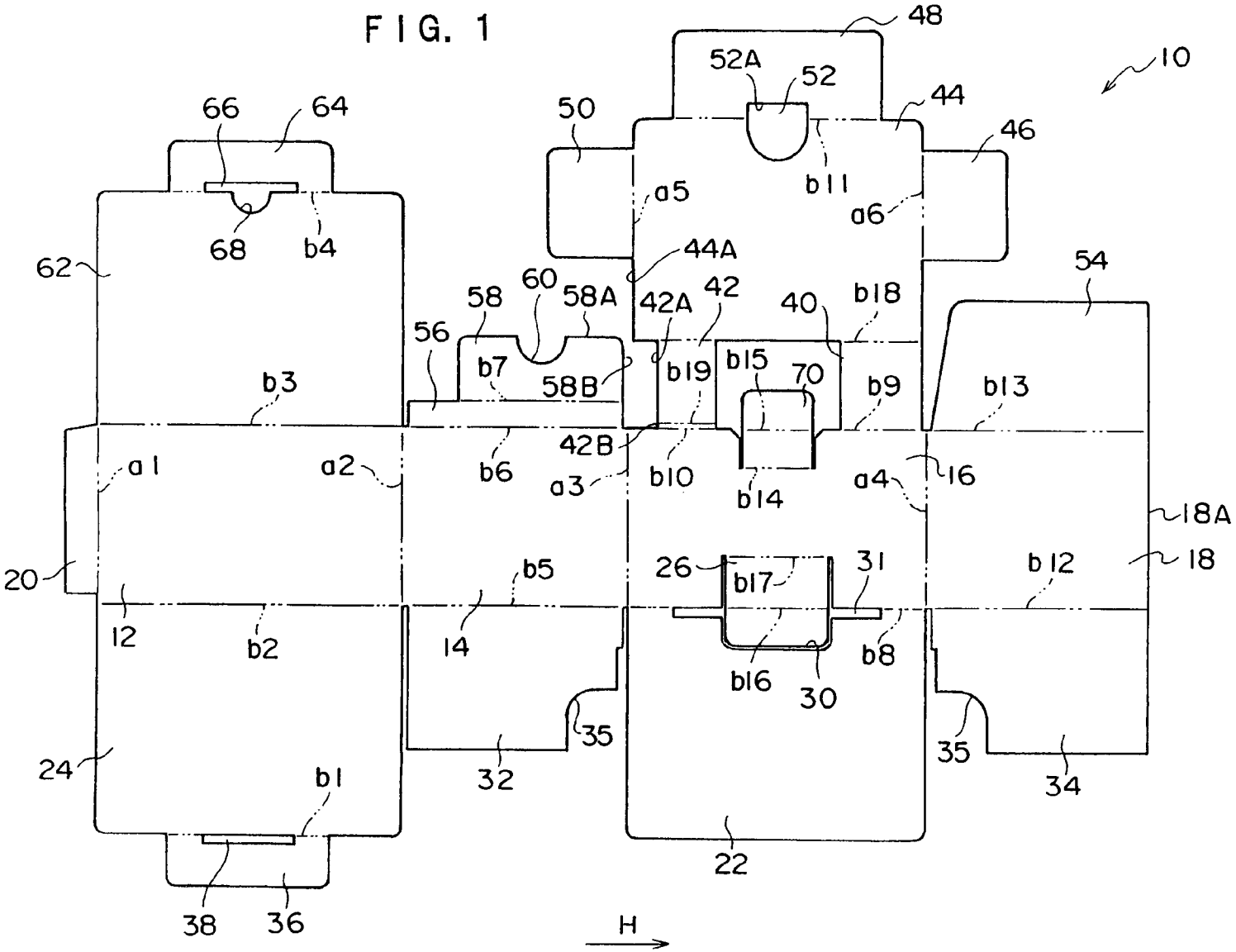
FIG. 1 is a development view of a package box according to a first embodiment.
Figure 2:
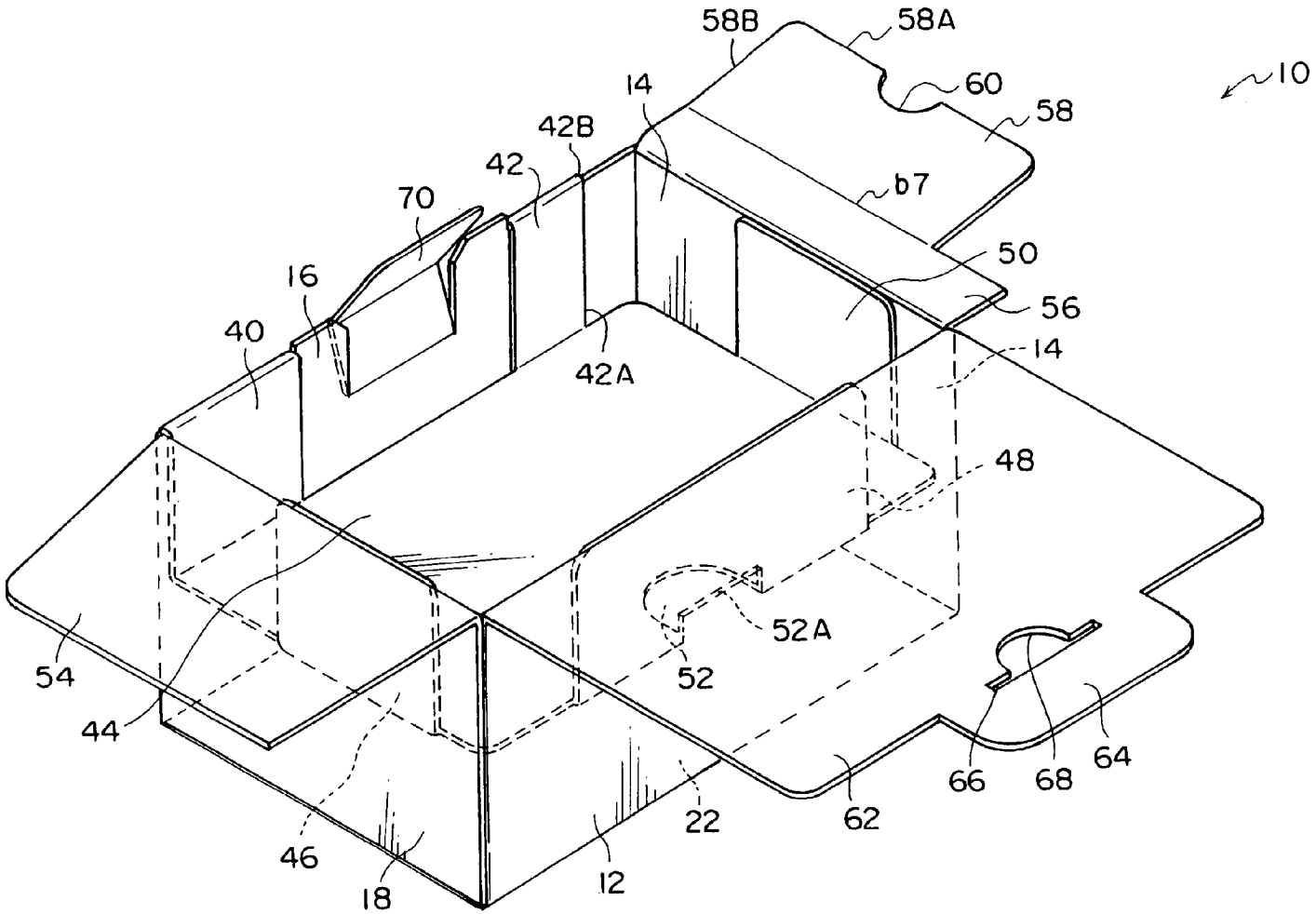
FIG. 2 is a perspective view of the package box showing a state in which a small partition plate of the first embodiment is unfolded open.
Figure 3:
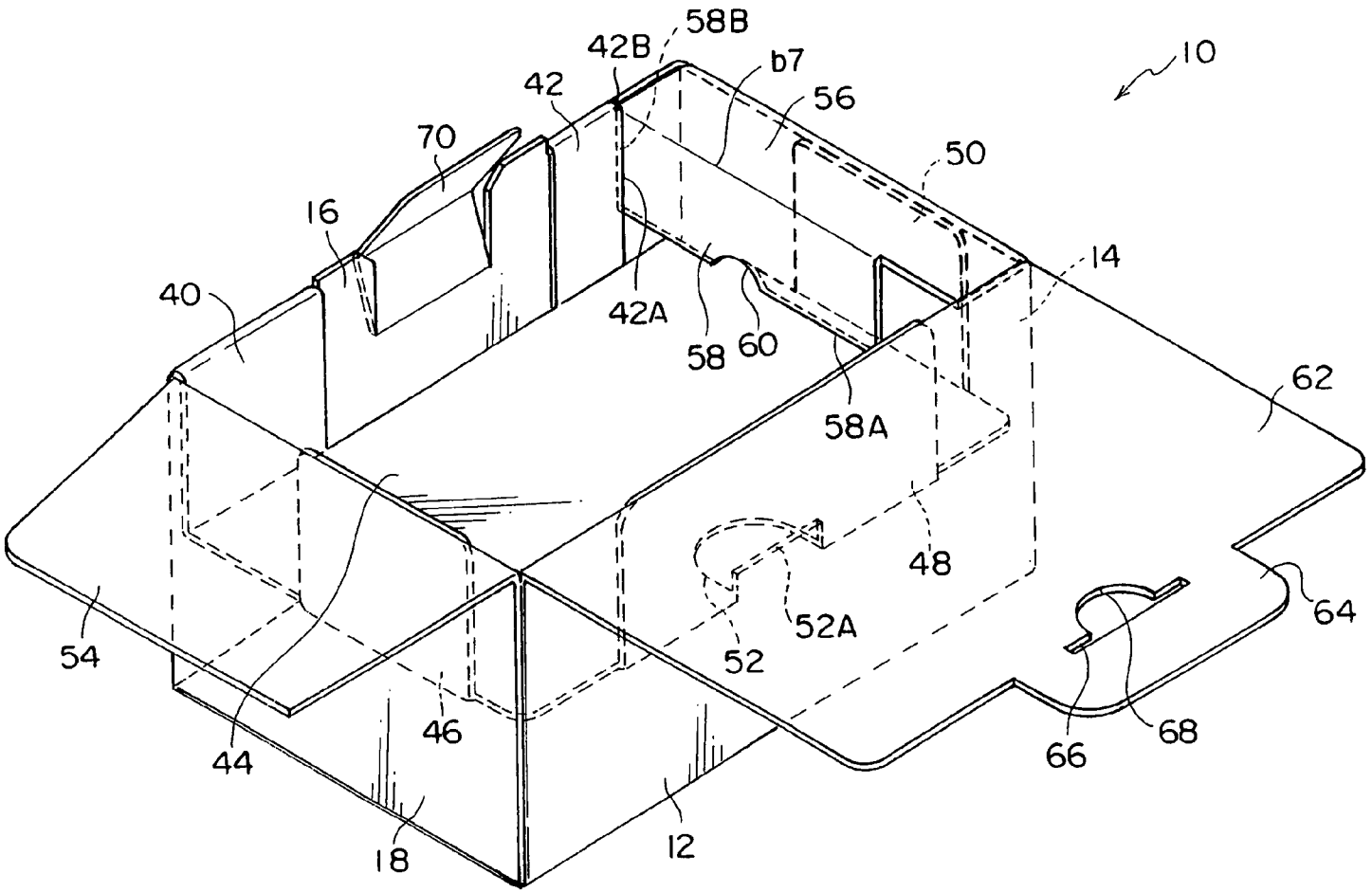
FIG. 3 is a perspective view of the package box showing a state in which the small partition plate of the first embodiment is folded.

FIG. 1 is a printed surface side development view of a package box 10 according to a first embodiment of the present invention. FIGS. 2 and 3 are perspective views of the package box 10 of the first embodiment. Phantom lines show creases. By folding along the phantom lines a box is formed, and printing can be carried out on the outside surfaces (print surfaces) to provide display effect.

As shown in FIGS. 1 to 3, a side plate 12, a side plate 14, a side plate 16 and a side plate 18 are continuously connected in that order in one direction (shown with the arrow H) through creases a2, a3, and a4 respectively. The sheet is folded at the creases a2, a3, and a4 such that surfaces opposite to the print surfaces (back surfaces) come inside and that adjacent side plates are perpendicular to each other.

An overlap width 20 is continuously connected through the crease a1 to an end side of the side plate 12 opposite to the crease a2. The overlap width 20 is folded at the crease a1 so as to be perpendicular to the side plate 12, and the overlap width 20 is pasted to the back surface of the side plate 18. The side plates 12, 14, 16 and 18 then form a box-shaped body, and form sidewalls of the package box 10.

In the drawings, a bottom plate 22 is continuously connected to a lower side of the side plate 16 through a crease b8, and the bottom plate 22 is folded at the crease b8 to become a bottom wall of the package box 10. A substantially U-shaped slit 30 is formed from the bottom plate 22 to the side plate 16, and the remaining cut portion is a plate piece 26. The side plate 16 and the plate piece 26 are continuously connected to each other through a crease b17. The plate piece 26 is folded at the crease b17, and the plate piece 26 is further folded at the crease b16 such that its back surface comes inside. A slit 31 having a width of a thickness of the plates is formed at an upper side of the bottom plate 22 extending outwardly from the slit 30. A stopper plate 36 of a later-described bottom plate 24 is to be inserted into the slit 31.

A bottom piece 32 is continuously connected to a lower side of the side plate 14 through a crease b5, and the bottom piece 32 is folded at the crease b5 such that its back surface comes inside and the bottom piece 32 is perpendicular to the side plate 14, and the bottom piece 32 overlaps the bottom plate 22 which has a print surface.

A bottom piece 34 is continuously connected to a lower side of the side plate 18 through a crease b12. The bottom piece 34 is folded such that the bottom piece 34 is perpendicular to the side plate 18 and its back surface comes inside, and such that the bottom piece 34 overlaps the bottom plate 22 which has a print surface.

A corner of each of the bottom pieces 32 and 34 is provided with a notch 35 so that when the bottom pieces 32 and 34 are folded and overlap the bottom plate 22, the plate piece 26 of the bottom plate 22 and the slit 31 are not covered by the bottom pieces 32 and 34.

A bottom plate 24 is continuously connected to a lower side of the side plate 12. The bottom plate 24 is folded at a crease b2 such that the bottom plate 24 is perpendicular to the side plate 12 and a back surface of the bottom plate 24 comes inside. The bottom plate 24 overlaps the bottom piece 32 and the bottom piece 34 which overlap the bottom plate 22 which has a print surface.

A stopper plate 36 is continuously connected to a lower side of the bottom plate 24 through a crease b1. The stopper plate 36 is folded at the crease b1 such that it is perpendicular to the bottom plate 24 and a back surface of the stopper plate 36 comes inside, and such that the stopper plate 36 is inserted into the slit 31 of the bottom plate 22. A slit 38 is formed in a central portion of the crease b1 of the stopper plate 36. When the stopper plate 36 is inserted into the slit 31, the plate piece 26 is inserted into the slit 38.

With the above structure, the bottom piece 32 and the bottom piece 34 overlap the bottom plate 22, and the bottom plate 24 is further overlapped thereon, to form a bottom wall of the package box 10. At which time, the stopper plate 36 is inserted into the slit 31, the plate piece 26 is inserted into the slit 38, and the bottom plate 24 is prevented from unfolding open by the restoring force of the crease b1.

A lid stopper 70 is continuously connected to a central portion of an upper side of the side plate 16 through a crease b14, at which the lid stopper 70 can be folded. The lid stopper 70 is folded at a crease b5 such that its back surface comes inside, and the lid stopper 70 is inserted into a later-described slit 66.

Connection pieces 40 and 42 are continuously connected to an upper side of the side plate 16 respectively through creases b9 and b10 at a predetermined distance from each other. An intermediate partition plate 44 is continuously connected to the connection piece 40 and the connection piece 42 through the crease b18. An edge side 42A of the connection piece 42 is offset closer to the connection piece 40 than an edge side 44A of the intermediate partition plate 44, and the edge side 42A is engaged with an edge side 58B of a later-described small partition plate 58.

The connection piece 42 is folded at the crease b10 at 90° with respect to the side plate 16 such that a back surface of the connection piece 42 comes inside, and the connection piece 42 is further folded at a crease b19 at 90°. At that time, the edge side 42A of the connection piece 42 is formed with an engaging portion 42B which is formed from the creases b10 and b19, and an end of the edge side 58B of the small partition plate 58 is engaged with the engaging portion 42B.

The intermediate partition plate 44 has substantially the same shape as that of the bottom plate 22. The connection pieces 40 and 42 are respectively folded at the crease b9 and the creases b10 and b19 such that the back surface of the side plate 16 and back surfaces of the connection pieces 40 and 42 are superposed on each other. When the intermediate partition plate 44 is folded at the crease b18 such that it is perpendicular to the connection piece 40 and a print surface of the intermediate partition plate 44 comes inside, the intermediate partition plate 44 divides the space inside the package box 10 into an upper first accommodation portion and a lower second accommodation portion in a plane which is parallel to the bottom plate 22.

Substantially rectangular flaps 46, 48 and 50 are continuously connected to the edge sides of the intermediate partition plate 44 through creases a6, b11 and a5 respectively. The flaps 46, 48 and 50 are folded at the creases a6, b1 and a5 such that print surfaces of the flaps come inside and the flaps are perpendicular to the intermediate partition plate 44. The flap 46 comes into surface contact with the side plate 18, the flap 48 comes into surface contact with the side plate 12, and the flap 50 comes into surface contact with the side plate 14, thereby holding the intermediate partition plate 44 in the package box 10.

A substantially U-shaped opening 52 is formed astride the intermediate partition plate 44 and the flap 48. When the flap 48 is folded and is in surface contact with the side plate 12, if the straight portion 52A of the opening 52 is pulled out with a user's finger, the intermediate partition plate 44 can easily be pulled out as compared with if the opening 52 were not provided.

A small connection piece 56 is continuously connected to an upper side of the side plate 14 through a crease b6, and the small connection piece 56 is folded at the crease b6 such that it is perpendicular to the side plate 14 and a back surface of the small connection piece 56 comes inside. The small partition plate 58 is continuously connected to an upper side of the small connection piece 56 through a crease b7. The small partition plate 58 is folded at the crease b7 such that it is perpendicular to the small connection piece 56 and a back surface of the small partition plate 58 comes inside. A central portion of an edge side 58A of the small partition plate 58 is formed with a finger hole 60.

When the small connection piece 56 and the small partition plate 58 are folded, a predetermined gap is formed between the intermediate partition plate 44 and the edge side 58A of the small partition plate 58. At this time, the edge side 58B of the small partition plate 58 abuts against the edge side 42A of the connection piece 42 so that the small partition plate 58 is prevented from unfolding open by the restoring force of the crease b7.

A lid 62 is continuously connected to an upper side of the side plate 12 through a crease b3. The lid 62 is folded at the crease b3 such that the lid 62 is perpendicular to the side plate 12 and a back surface of the lid 62 comes inside. A stopper plate 64 is continuously connected to an upper side of the lid 62 through a crease b4. The stopper plate 64 is folded at the crease b4 such that the stopper plate 64 is perpendicular to the lid 62 and a back surface of the stopper plate 64 comes inside. The stopper plate 64 is inserted between the connection piece 40 and the connection piece 42.

A slit 66 is formed in a central portion of the crease b4 of the stopper plate 64 so that the lid stopper 70 can be inserted into the slit 66. A finger hole 68 which is continuous with the slit 66 is formed in an upper side of the lid 62. When the lid stopper 70 is to be removed from the slit 66, the lid stopper 70 can be pulled on with a user's finger through the finger hole 68, and the lid stopper 70 is then easily be pulled out.

The lid 62 is folded over and becomes an upper wall of the package box 10. At which time, the stopper plate 64 is folded and inserted between the connection pieces 40 and 42. Further, the lid stopper 70 is inserted into the slit 66 of the stopper plate 64, and the lid 62 is prevented from unfolding open by the restoring force of the crease b3.

A flap 54 is continuously connected to an upper side of the side plate 18 through a crease b13. The flap 54 is folded at the crease b13 such that it is perpendicular to the side plate 18 and a back surface of the flap 54 comes inside. The flap 54 is accommodated on the inner side of the lid 62.

Next, the operation of the first embodiment will be explained.

As shown in FIGS. 1 and 2, the side plate 12, the side plate 14, the side plate 16 and the side plate 18 are folded at the creases a2, a3 and a4, respectively and form a box-shaped body. The side plate 18 and the overlap width 20 are adhered to each other with an adhesive, and they form sidewalls of the package box 10.

Here, the bottom plate 22 is folded at the crease b8, the bottom piece 32 and the bottom piece 34 are folded at the creases b5 and b12, respectively, and overlap the bottom plate 22. The bottom plate 24 is folded at the crease b2, and overlaps the bottom piece 32 and the bottom piece 34, and a bottom surface of the package box 10 is formed. At that time, the stopper plate 36 folded at the crease b1 is inserted into the slit 31 of the bottom plate 22. The plate piece 26 of the side plate 16 is once folded at the crease b17 toward the print surface, and a tip end of the plate piece 26 is folded at the crease b16 and is inserted into the slit 38 of the stopper plate 36. In this manner, the bottom plate 24 is locked to the side plate 16.

The flap 54 and the lid 62 are folded respectively at the crease b13 and the crease b3, and the lid 62 overlaps the flap 54. The flap 54 and the lid 62 then serve as an upper wall of the package box 10.

When the lid 62 is folded to close the opening of the package box 10, the lid stopper 70 is once folded at the crease b14 toward the outside of the box, the tip end of the lid stopper 70 is folded at the crease b15 and inserted into the slit 66 of the lid 62. In this manner, the lid 62 is locked to the side plate 16.

The connection pieces 40 and 42 are folded at the crease b9 and b10, and the intermediate partition plate 44 is folded at the crease b18. Further, the flaps 46, 48 and 50 are folded at the creases a6, b11 and a5, and come into surface contact with the side plates 18, 12 and 14, respectively, and the flaps are held in the package box 10. At that time, the interior of the package box 10 is divided into the first accommodation portion and the second accommodation portion by the intermediate partition plate 44. An article to be packaged such as a digital camera placed on a tray is accommodated in the second accommodation portion.

Figure 4:
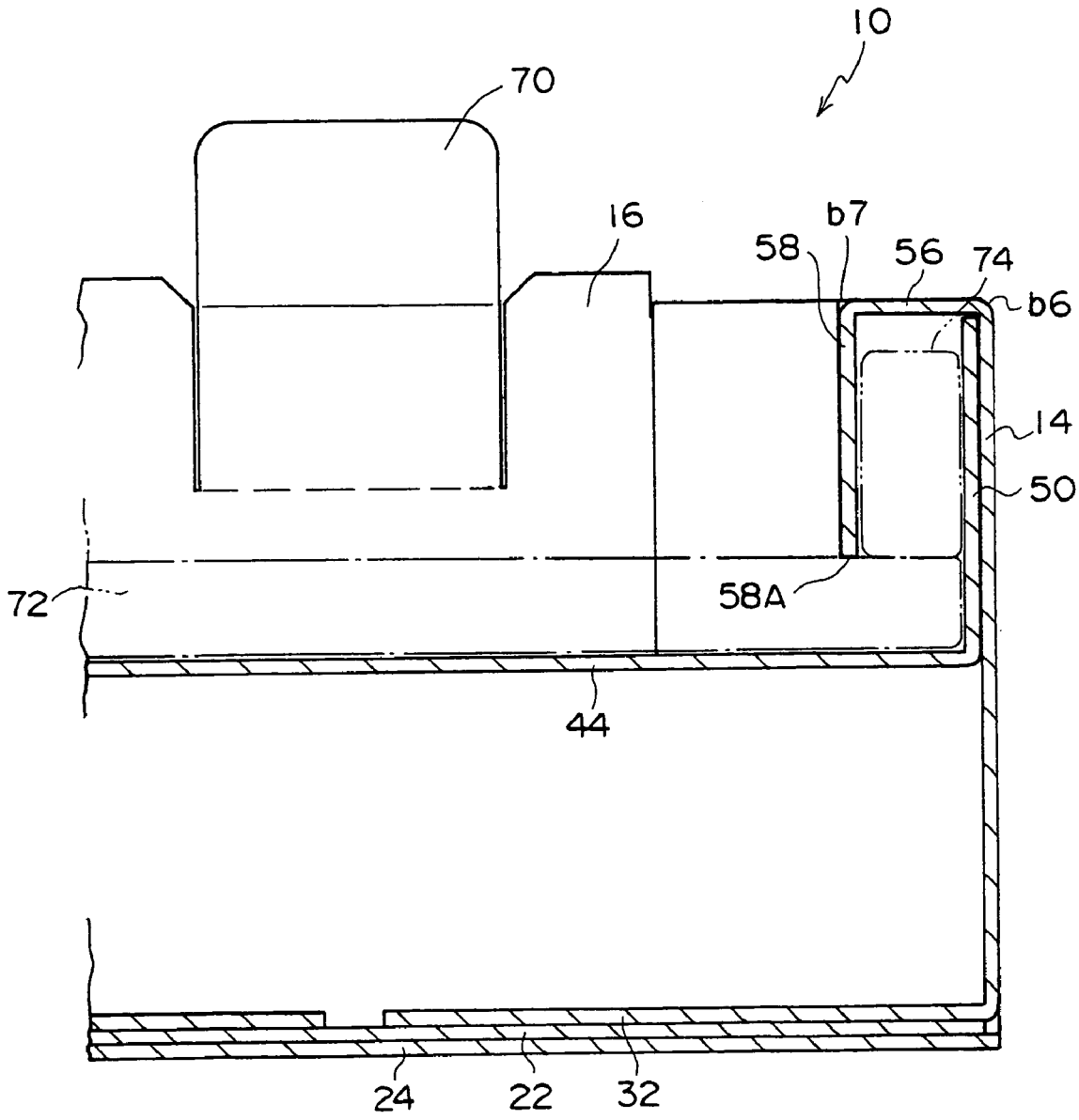
FIG. 4 is a sectional view of the package box showing a state in which the small partition plate of the first embodiment is folded.

If the small connection piece 56 is folded at the crease b6 and the small partition plate 58 is folded at the crease b7, a third accommodation portion is formed in the first accommodation portion as shown in FIGS. 3 and 4. A small article 74 such as an attachment is accommodated in the third accommodation portion.

When the small partition plate 58 is folded at the crease b7, a predetermined gap is provided between the edge side 58A of the small partition plate 58 and the intermediate partition plate 44. An instruction manual 72 having substantially the same thickness as the gap can be accommodated on the intermediate partition plate 44.

The space above the intermediate partition plate 44 can effectively utilized, and the package box 10 is not increased in size. Therefore, the package box 10 requires less material to be used, and this reduces the cost. If the small partition plate 58 is folded at the crease b7, the third accommodation portion is formed above the instruction manual 72.

As shown in FIG. 3, when the small connection piece 56 and the small partition plate 58 form the third accommodation portion, the edge side 58B of the small partition plate 58 is engaged with the edge side 42A of the connection piece 42, and the end of the edge side 58B abuts against the engaging portion 42B formed between the crease b10 and the crease b19 of the edge side 42A so that the small partition plate 58 does not unfold open by the restoring force of the crease b7. With this structure, assembling time can be shortened as compared with a case in which a hole is formed in the intermediate partition plate 44 to prevent the small partition plate 58 from unfolding open and the tip end of the small partition plate 58 is inserted into the hole.

The small partition plate 58 is formed with the finger hole 60. When the small article 74 accommodated in the third accommodation portion is to be taken out, if the small partition plate 58 is pulled out in the developing direction with a user's finger put into the finger hole 60, the small article 74 in the third accommodation portion can be taken out. It is easier to take out the small article 74 accommodated in the third accommodation portion as compared with a case in which there is no finger hole 60.

Next, a package box of a second embodiment will be explained.

Figure 5:
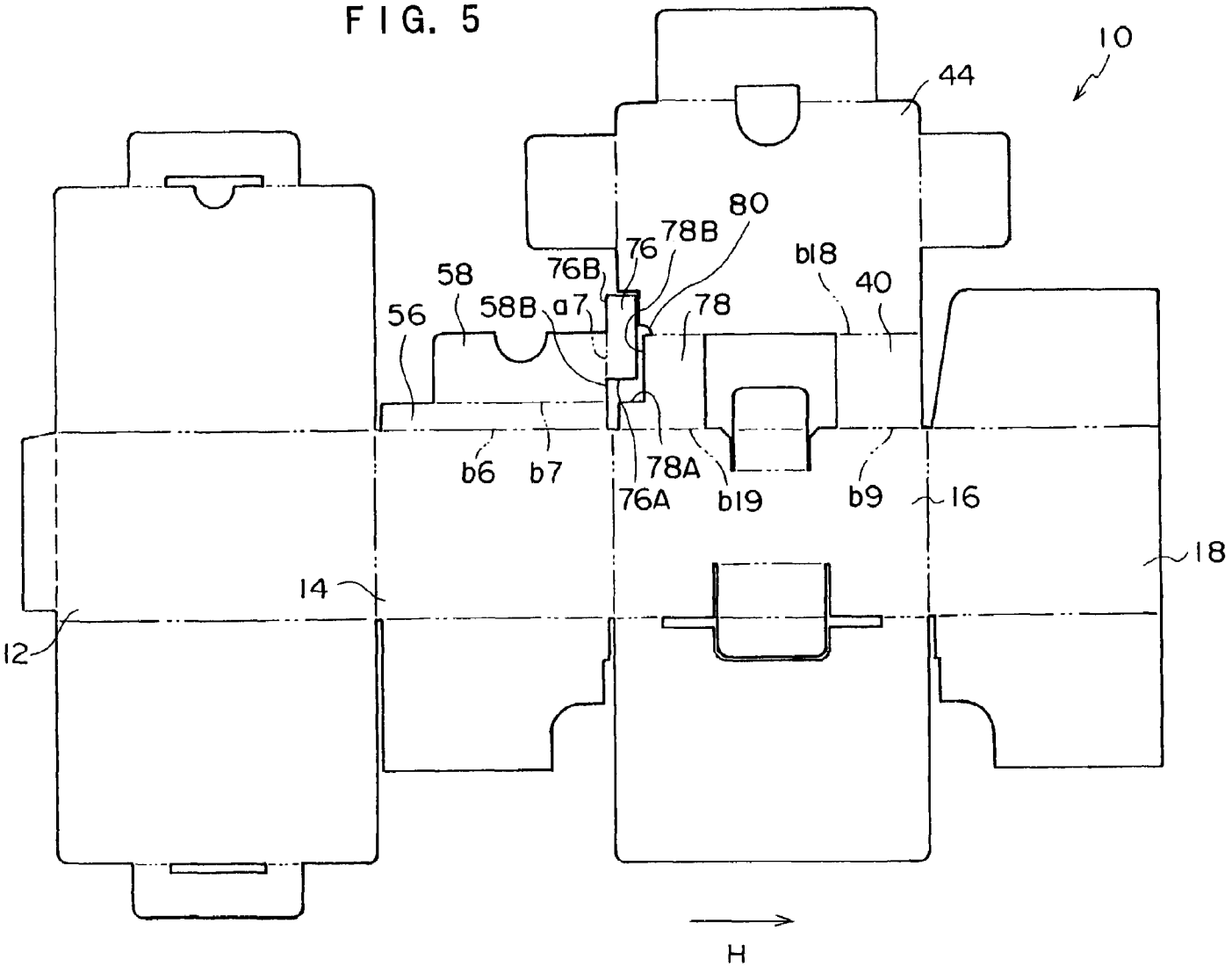
FIG. 5 is a development view of a package box according to a second embodiment.
Figure 6:
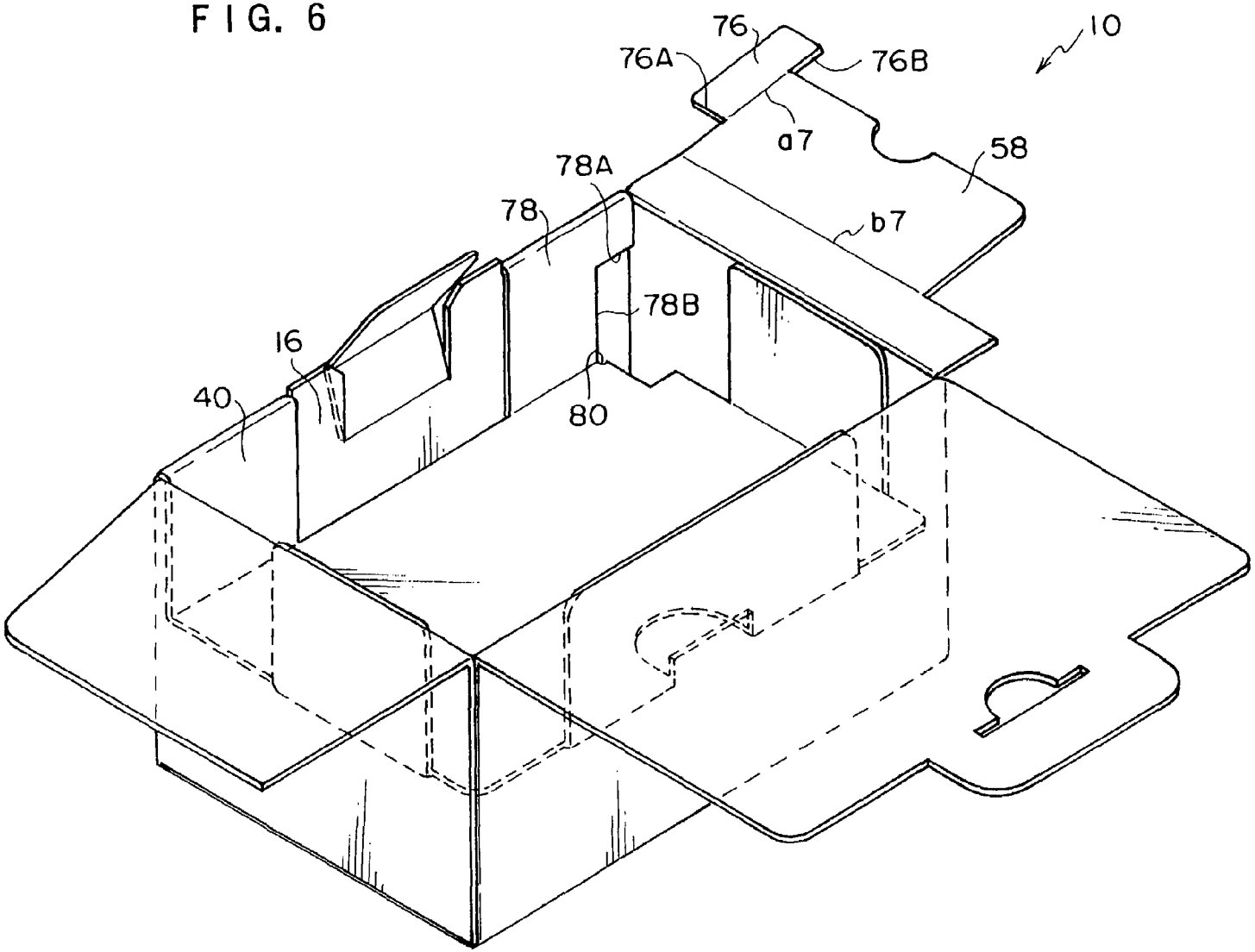
FIG. 6 is a perspective view of the package box showing a state in which a small partition plate of the second embodiment is unfolded open.
Figure 7:
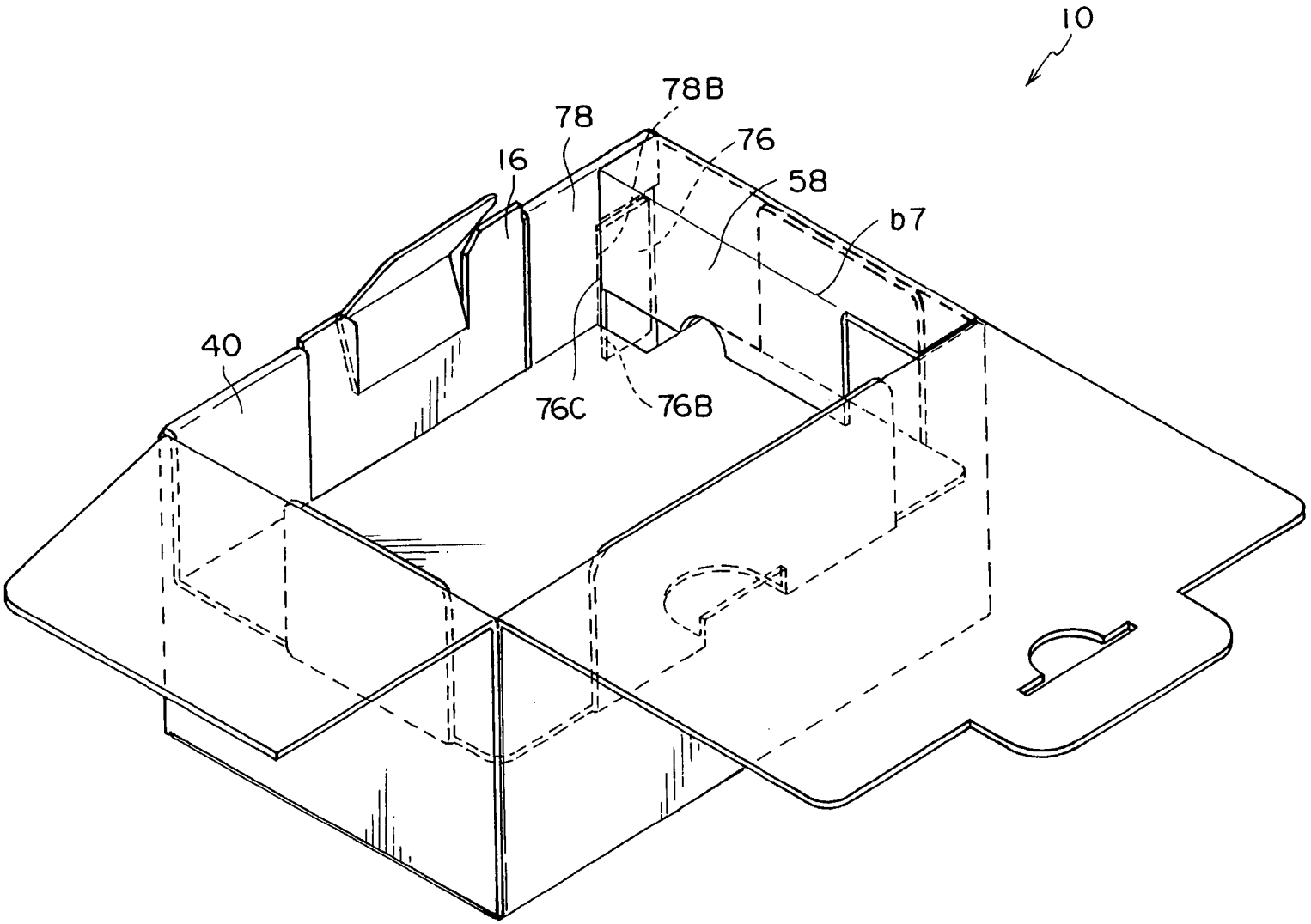
FIG. 7 is a perspective view of the package box showing a state in which the small partition plate of the second embodiment is folded.

FIG. 5 is a development view of the package box 10 according to the second embodiment on the side of the print surface. FIGS. 6 and 7 are perspective views of the package box 10 of the second embodiment. Explanation of portions of the second embodiment similar to the first embodiment will be omitted.

As shown in FIGS. 5 to 7, connection pieces 40 and 78 are continuously connected to an upper side of the side plate 16 through creases b9 and b19 at a predetermined distance from each other. The intermediate partition plate 44 is continuously connected to the connection pieces 40 and 78 through the crease b18. The connection piece 78 is formed in a substantial L-shape, and an edge side 76A of an insertion piece 76 continuously connected to the small partition plate 58 through a crease a7 is engaged with an edge side 78A. The small partition plate 58 and the insertion piece 76 are folded at the crease a7 to form a corner 76C. The corner 76C is engaged with another edge side 78B of the connection piece 78. An engaging portion 80 is formed in a corner of the intermediate partition plate 44. A tip end of the insertion piece 76 is inserted into the engaging portion 80. The connection piece 40 and 78 are folded respectively along creases b9 and b19 at 180° such that their print surfaces come outside and a back surface of the connection piece 78 is in surface contact with a back surface of the side plate 16.

A corner of the intermediate partition plate 44 is formed with an engaging portion 80, and a tip end of the insertion piece 76 is inserted into the engaging portion 80.

Next, the operation of the second embodiment will be explained.

As shown in FIGS. 5 to 7, the small connection piece 56 and the small partition plate 58 are folded at the creases b6 and b7, respectively. When the insertion piece 76 is folded at the crease a7, the edge side 76A of the insertion piece 76 is engaged with the edge side 78A of the connection piece 78, and upward movement of the insertion piece 76 is restricted. The corner 76C formed when the small partition plate 58 and the insertion piece 76 are folded at the crease a7, and the edge side 76B of the insertion piece 76 existing on an extension line of the corner 76C are engaged with the edge side 78B of the connection piece 78, and unfolding of the small partition plate 58 by the restoring force of the crease b7 is prevented.

A tip end of the insertion piece 76 is engaged with the engaging portion 80 formed in the intermediate partition plate 44 so that the tip end is fixed. Therefore, unfolding of the small partition plate 58 caused by the restoring force of the crease b7 can reliably be prevented.

Next, a package box of a third embodiment will be explained.

Figure 8:
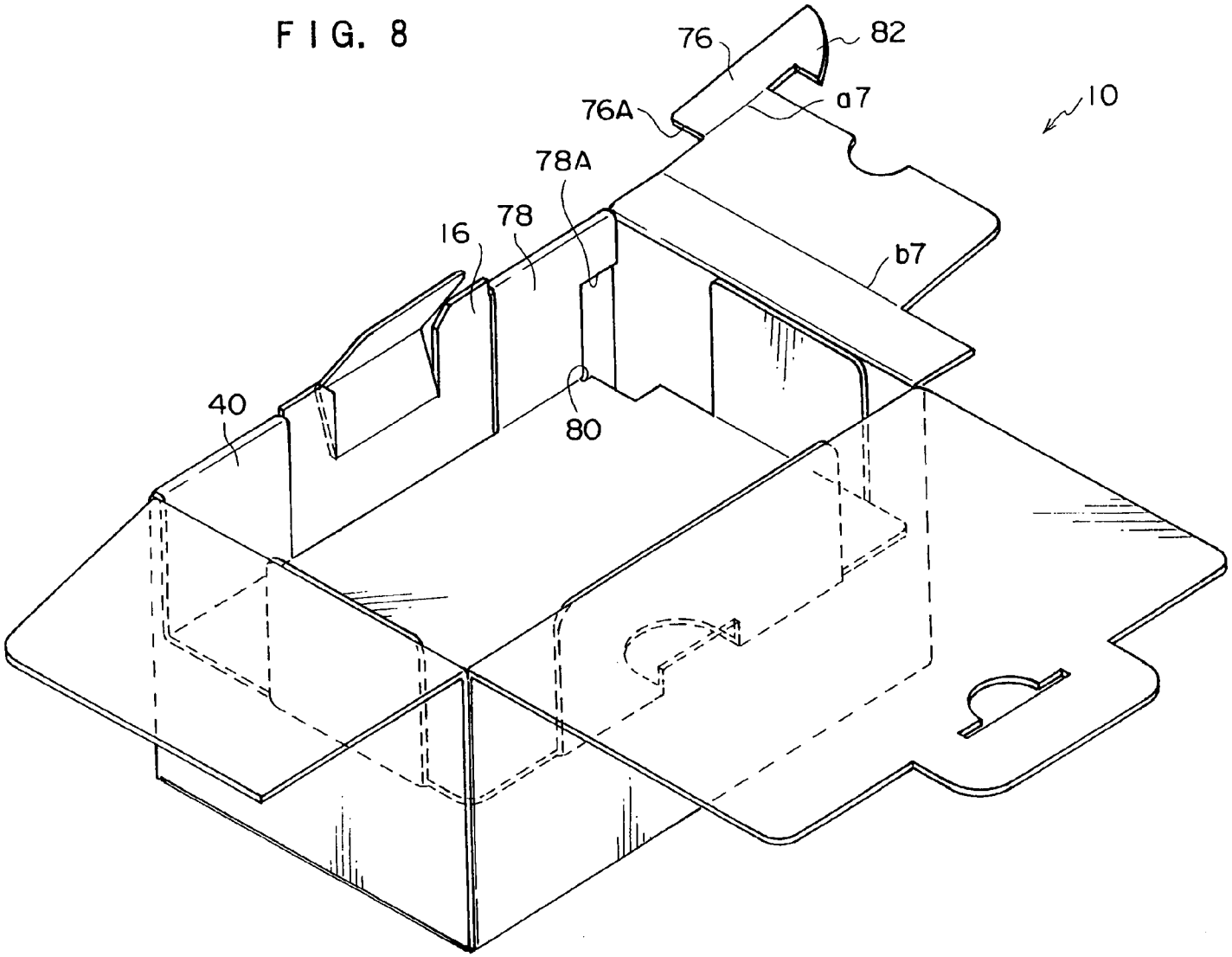
FIG. 8 is a perspective view of the package box showing a state in which a small partition plate of the third embodiment is unfolded open.

As shown in FIG. 8, the basic structure of the third embodiment is the same as that of the second embodiment. In the third embodiment, a tip end of the insertion piece 76 is formed with a hook 82. When the insertion piece 76 is folded at the crease b7, the hook 82 is engaged with the engaging portion 80 formed in the intermediate partition plate 44.

Next, the operation of the third embodiment will be explained.

As shown in FIG. 8, the insertion piece 76 of the small partition plate 58 is provided with the hook 82. When the insertion piece 76 of the small partition plate 58 is inserted into the engaging portion 80 of the intermediate partition plate 44, the hook 82 is caught on the engaging portion 80 so that the insertion piece 76 is not pulled out. Thus unfolding of the small partition plate 58 caused by the restoring force of the crease b7 is prevented.

Next, a package box of a fourth embodiment will be explained.

Figure 9:
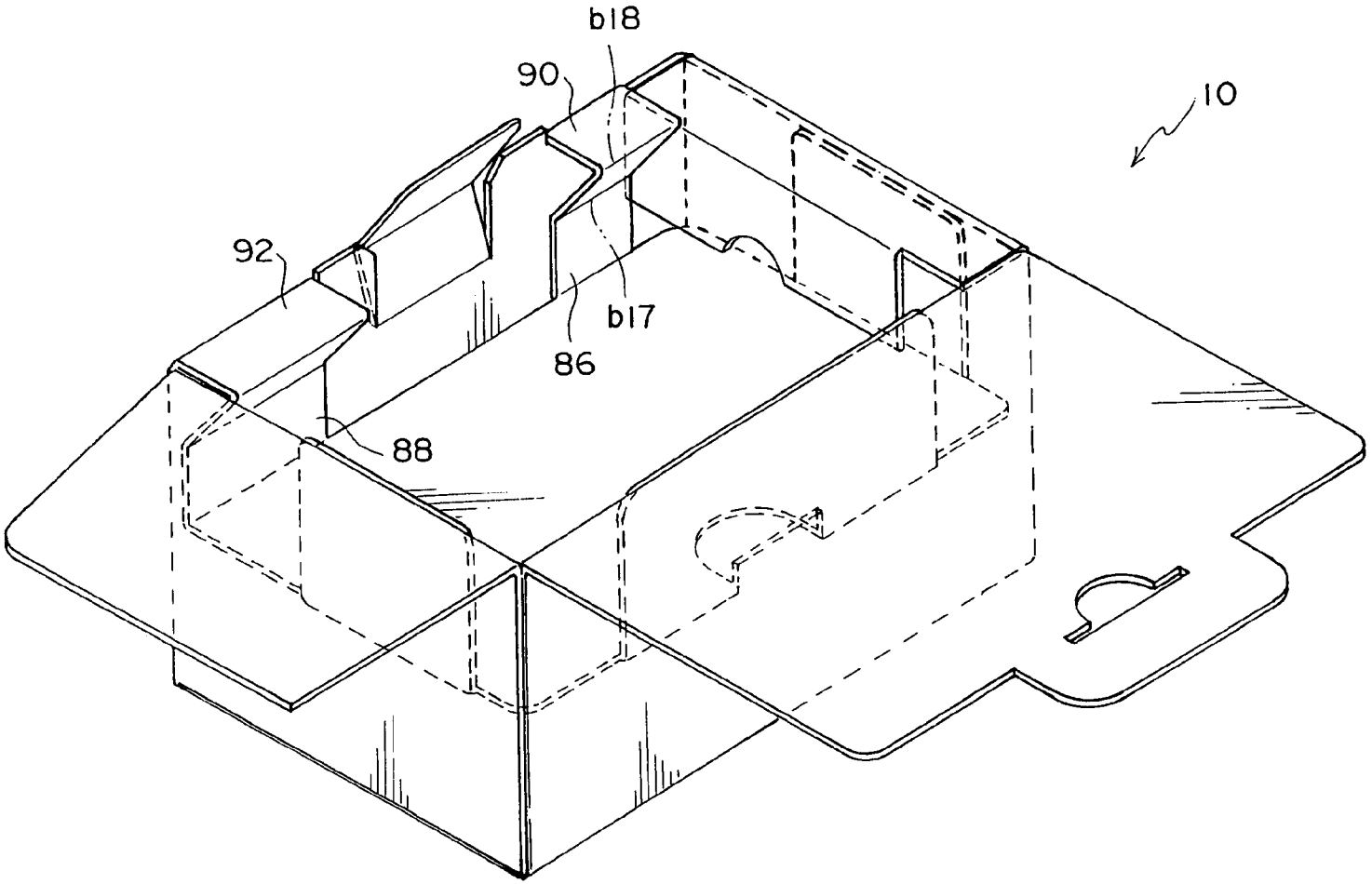
FIG. 9 is a perspective view of the package box showing a state in which a small partition plate of the fourth embodiment is unfolded open.
Figure 10:
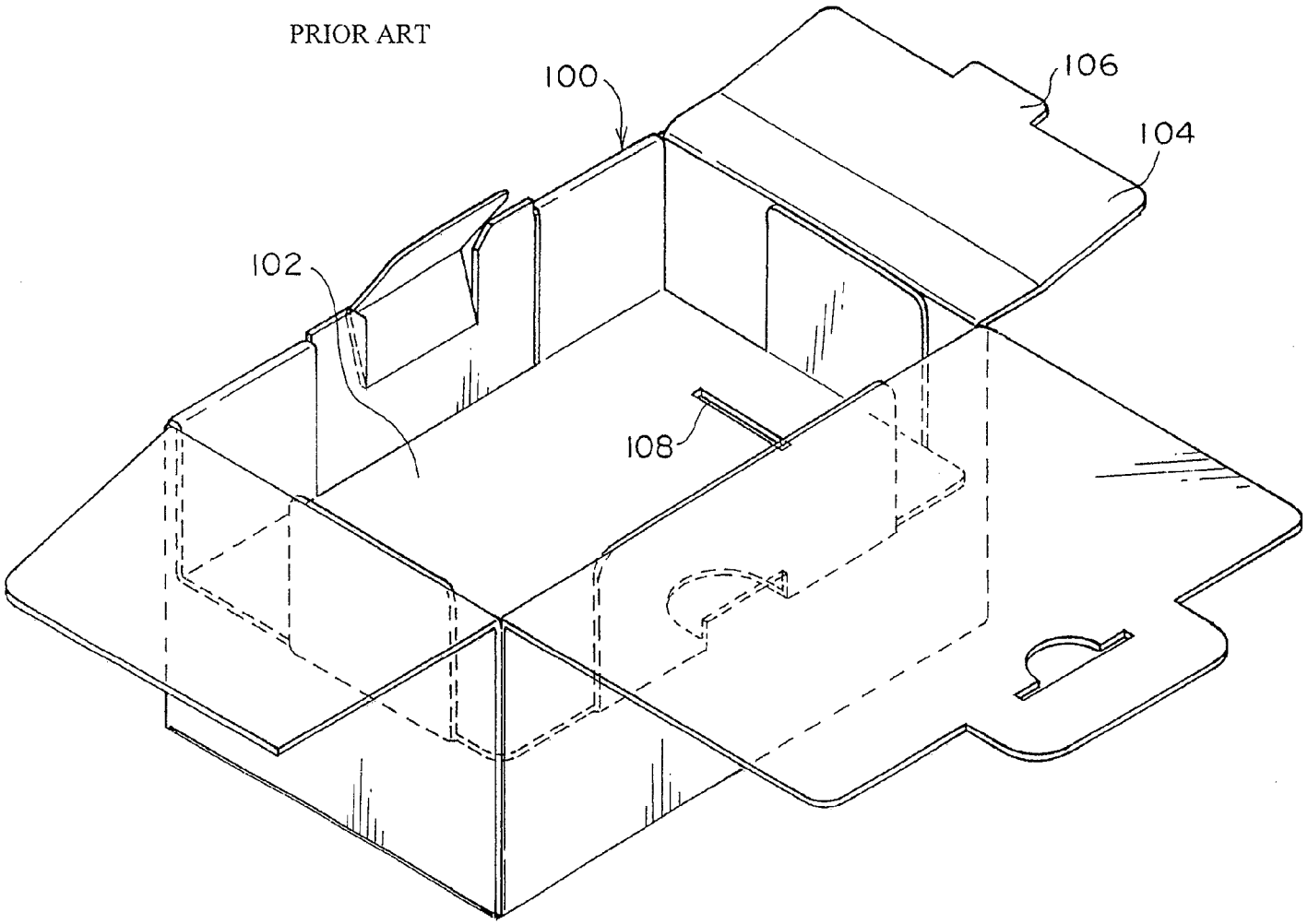
FIG. 10 PRIOR ART
FIG. 10 is a perspective view of a conventional package box.
Figure 11:
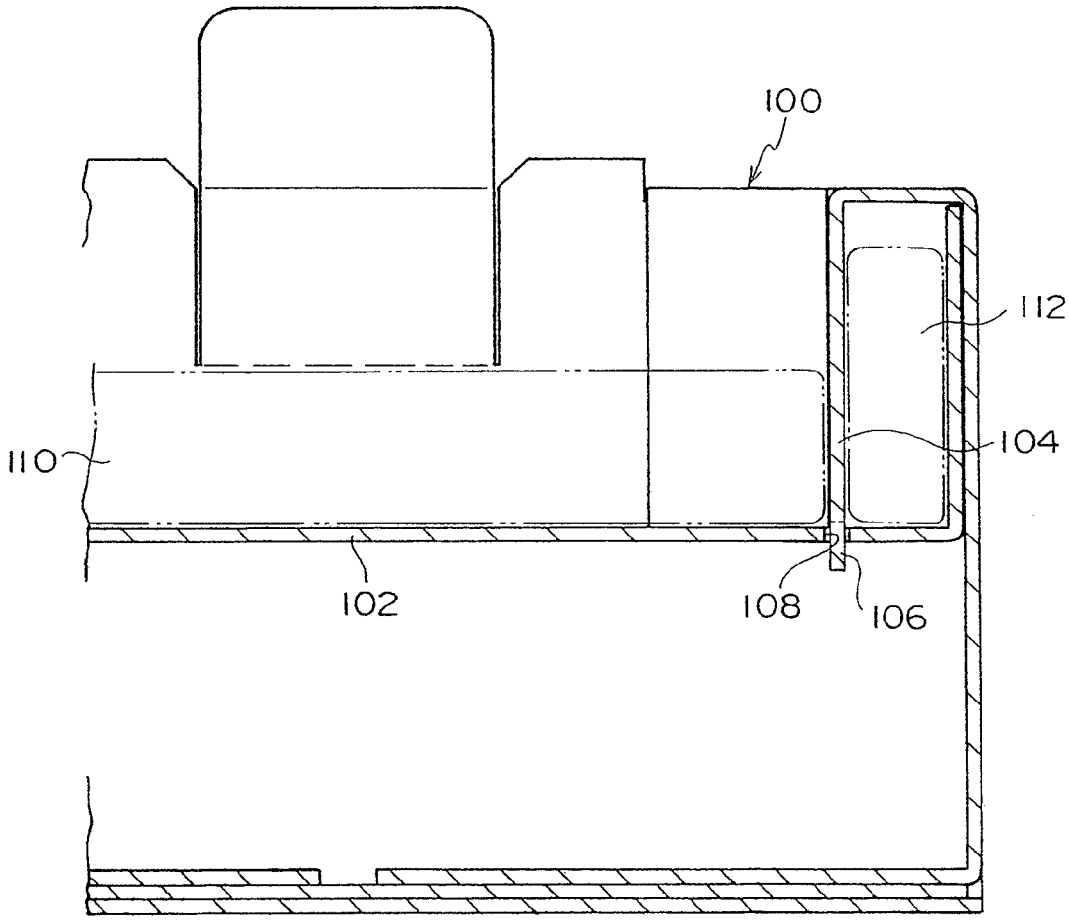
FIG. 11 PRIOR ART
FIG. 11 is a sectional view of the conventional package box.

As shown in FIG. 9, the basic structure of the fourth embodiment is the same as that of the first embodiment. In the fourth embodiment, connection pieces 86 and 88 are longer than the connection pieces 40 and 42 of the first embodiment. If the connection pieces 86 and 88 are folded at a crease b18 such that back surfaces thereof come inside and the connection pieces 86 and 88 are further folded at a crease b17 such that print surfaces thereof come inside, part of the connection pieces 86 and 88 project toward the inside of the package box 10, and bent portions 90 and 92 are formed. Thus unfolding of the small partition plate 58 caused by the restoring force of the crease b7 is prevented by the bent portions 90 and 92.

Next, the operation of the fourth embodiment will be explained.

When the connection pieces 86 and 88 are bent as shown in FIG. 9, the bent portions 90 and 92 are formed.

The bent portions 90 and 92 are formed such that the connection pieces 86 and 88 are bent and the bent portions 90 and 92 project toward the inside of the package box 10. Therefore, even if the small partition plate 58 is not formed with a member which prevents unfolding of the small partition plate 58, unfolding of the small partition plate 58 is reliably prevented. Further, it is only necessary to increase the lengths of the connection pieces 86 and 88 by an amount corresponding to the bent portions, and the structure of the package box 10 is largely simplified.

It is not always necessary that the bent portions 90 and 92 are formed by bending the connection pieces 86 and 88 only if the bent portions 90 and 92 project toward the inside of the package box 10. For example, an engaging plate may project toward the inside of the package box 10 from an edge side with which the small partition plate 58 of the connection piece 86 is engaged.

Although the lid 62 is provided in this embodiment, the lid 62 is not always necessary, and an article may be accommodated in the package box in a state in which the first accommodation portion is opened. Although the lid 62 is fixed using the lid stopper 70 provided on the upper side of the side plate 16, the lid 62 may cover the side plate 16 and may be fixed to a lower side of the side plate 16.

In the package box of the invention, the unfolding preventing portion may be an engaging portion (first engaging portion) which is formed on the first connection piece and is engaged with an edge of the held plate.

According to the above structure, the engaging portion is formed on the first connection piece and the edge of the held plate is engaged with the engaging portion, thereby preventing the held plate from unfolding open.

As compared with a case in which the partition plate is formed with a hole and the held plate is inserted into the hole to prevent the held plate from unfolding open, the time required for assembling the above structure is reduced, and thus, the cost can be reduced.

In the package box of the invention, the unfolding preventing portion may include an insertion piece projecting from an edge of the held plate, and the engaging portion (second engaging portion) which is formed on the first connection piece and is engaged with an upper side of the insertion piece when the held plate is folded into the box body.

According to this structure, the held plate is folded into the box body, and the upper side of the insertion piece projecting from the edge of the held plate is engaged with the engaging portion which is formed on the first connection piece.

The insertion piece of the held plate is engaged with the engaging portion formed on the first connection piece, the insertion piece is prevented from moving upward, and the unfolding of the held plate is prevented.

In the package box of the invention, the insertion piece may project from a free edge of the held plate and is inserted into the slit (third engaging portion) formed on a corner of the partition plate nearest to the first connection piece.

According to the above structure, the held plate is folded into the box body, and the insertion piece of the held plate is inserted into the slit formed in the corner of the partition plate nearest to the first connection piece. Since the insertion piece projects from the free edge of the held plate, the insertion piece can not move out of the slit. Therefore, the held plate is prevented from unfolding open by the insertion piece and the slit.

In the package box of the invention, the insertion piece may be provided with a hooking portion.

With this structure, when the insertion piece of the held plate is provided with the hooking portion and the insertion piece of the held plate is inserted into the slit, the hooking portion is caught on the slit and can not move out and thus, the held plate does not unfold open.

In the package box of the invention, the unfolding preventing portion may be a bent portion formed such that the first connection piece is folded and projects toward the accommodation space, and the held plate is prevented from unfolding open.

According to this structure, the first connection piece is bent to form a bent portion, and this bent portion prevents the held plate from unfolding open.

The bent portion is formed such that that the first connection piece is bent and projects toward the accommodation space. Therefore, even if the held plate is not formed with a member which prevents unfolding of the held plate, unfolding of the held plate is reliably be prevented. Further, it is only necessary to increase the length of the first connection piece by an amount corresponding to the bent portion, and the structure of the box body is largely simplified.

In the package box of the invention, the held plate may have such a size that when the held plate is folded into the box body, a predetermined gap is formed between the partition plate and the free edge of the held plate.

According to this structure, the predetermined gap is formed between the partition plate and the free edge of the held plate, and an article having a thickness substantially the same as that of the predetermined gap can be placed on the whole area of the partition plate.

Therefore, a printed matter or the like having the same size as that of the partition plate can be placed on the first accommodation portion, a third accommodation portion is formed above the printed matter or the likes by the held plate, and a small article or the like can be accommodated in the third accommodation portion.

Since a printed matter or the like can be accommodated in the first accommodation portion and the small article or the like can be accommodated above the first accommodation portion, the space above the partition plate can effectively be utilized. Thus, the size of the box is not increased, the amount of material required for the box is small, and the cost can be reduced.

In the package box of the invention, the free edge of the held plate may be formed with a finger hole.

According to this structure, since the free edge of the held plate is formed with the finger hole, if a user's finger is put in the finger hole to unfold open the held plate, a small article or the like accommodated in the third accommodation portion can easily be taken out.

What is claimed is:

1. A package box comprising:

a box body having an opening through which an article to be packaged can be put into and taken out of the box body;

a first connection piece which is integrally and continuously connected to one side of the opening and which is folded toward an inner wall of the box body;

a partition plate which is integrally and continuously connected to the first connection piece and which partitions an accommodation space surrounded by the box body into an upper first accommodation portion and a lower second accommodation portion when the partition plate is folded into the box body;

a second connection piece integrally and continuously connected to another side of the opening which is substantially perpendicular to the one side;

a held plate which is integrally and continuously connected to the second connection piece and which is folded toward the inside of the box body such that the first accommodation portion is formed with a third accommodation portion; and an unfolding preventing portion which is provided on the first connection piece and which prevents the held plate folded toward the inside of the box body from unfolding open, wherein the unfolding preventing portion includes an insertion piece projecting from an edge of the held plate, a first engaging portion which is formed on the first connection piece to engage with a side of the held plate, the side being formed by bending the held plate and the insertion piece, and a second engaging portion which is formed on the first connection piece and which engages with an upper side of the insertion piece when the held plate is folded toward the inside of the box body.

2. The package box according to claim 1, wherein the insertion piece is provided with a hooking portion.

3. The package box according to claim 2, wherein the hooking portion is formed on a tip edge of the insertion piece, and is inserted into a third engaging portion formed on a corner of the partition plate nearest to the first connection piece.

4. The package box according to claim 1, wherein the insertion piece is inserted into a third engaging portion formed on a corner of the partition plate nearest to the first connection piece.

5. The package box according to claim 4, wherein the third engaging portion includes a notch into which a tip end of the insertion piece is inserted.

6. The package box according to claim 4, wherein the insertion piece is provided with a hooking portion.

7. The package box according to claim 6, wherein the hooking portion is formed on a tip edge of the insertion piece and is inserted into the third engaging portion.

8. The package box according to claim 1, wherein a free edge of the held plate is formed with a finger hole.

9. The package box according to claim 1, wherein the unfolding preventing portion includes an engaging plate which projects toward the accommodation space and which prevents the held plate from unfolding open.

10. The package box according to claim 1, further comprising a lid which covers the opening through which an article to be packaged can be put into and taken out of the box body.

11. A package box comprising:

a box body having an opening through which an article to be packaged can be put into and taken out of the box body;

a first connection piece which is integrally and continuously connected to one side of the opening and which is folded toward an inner wall of the box body;

a partition plate which is integrally and continuously connected to the first connection piece and which partitions an accommodation space surrounded by the box body into an upper first accommodation portion and a lower second accommodation portion when the partition plate is folded into the box body;

a second connection piece integrally and continuously connected to another side of the opening which is substantially perpendicular to the one side;

a held plate which is integrally and continuously connected to the second connection piece and which is folded toward the inside of the box body such that the first accommodation portion is formed with a third accommodation portion; and an unfolding preventing portion which is provided on the first connection piece and which prevents the held plate folded toward the inside of the box body from unfolding open, wherein the unfolding preventing portion includes a bent portion which is formed such that the first connection piece is bent away from the inner wall and projects toward the accommodation space, and which prevents the held plate from unfolding open.

12. A package box comprising:

a box body having an opening through which an article to be packaged can be put into and taken out of the box body;

a first connection piece which is integrally and continuously connected to one side of the opening and which is folded toward an inner wall of the box body;

a partition plate which is integrally and continuously connected to the first connection piece and which partitions an accommodation space surrounded by the box body into an upper first accommodation portion and a lower second accommodation portion when the partition plate is folded into the box body;

a second connection piece integrally and continuously connected to another side of the opening which is substantially perpendicular to the one side;

a held plate which is integrally and continuously connected to the second connection piece and which is folded toward the inside of the box body such that the first accommodation portion is formed with a third accommodation portion; and an unfolding preventing portion which is provided on the first connection piece and which prevents the held plate folded toward the inside of the box body from unfolding open, wherein the unfolding preventing portion includes an insertion piece projecting from an edge of the held plate, a first engaging portion which is formed on the first connection piece to engage with a side of the held plate, the side being formed by bending the held plate and the insertion piece, a second engaging portion which is formed on the first connection piece and which engages with an upper side of the insertion piece when the held plate is folded toward the inside of the box body, wherein the held plate has such a size that when the held plate is folded into the box body, a predetermined gap is formed between the partition plate and a free edge of the held plate.

13. A package box comprising:

a box body having an opening through which an article to be packaged can be put into and taken out of the box body;

a first connection piece which is integrally and continuously connected to one side of the opening and which is folded toward an inner wall of the box body;

a partition plate which is integrally and continuously connected to the first connection piece and which partitions an accommodation space surrounded by the box body into an upper first accommodation portion and a lower second accommodation portion when the partition plate is folded into the box body;

a second connection piece integrally and continuously connected to another side of the opening which is substantially perpendicular to the one side;

a held plate which is integrally and continuously connected to the second connection piece and which is folded toward the inside of the box body such that the first accommodation portion is formed with a third accommodation portion; and an unfolding preventing portion which is provided on the first connection piece and which prevents the held plate folded toward the inside of the box body from unfolding open, wherein the unfolding preventing portion includes an insertion piece projecting from an edge of the held plate, a first engaging portion which is formed on the first connection piece to engage with a side of the held plate, the side being formed by bending the held plate and the insertion piece, and a second engaging portion which is formed on the first connection piece and which engages with an upper side of the insertion piece when the held plate is folded toward the inside of the box body, wherein a substantially rectangular plate is continuously connected to at least one of the sides of the partition plate except a side thereof which is integrally and continuously connected to the first connection piece, and the plate is folded such that it is substantially perpendicular to the partition plate and which comes into surface contact with an inner side surface of the box body.

14. The package box according to claim 13, wherein the plate is continuously connected to a side of the partition plate, the side being opposite to a side thereof to which the first connection piece and the partition plate are integrally and continuously connected to each other, and a substantially U-shaped hole is formed astride the plate and the partition plate.

15. A package box comprising:

a box body having an opening through which an article to be packaged can be put into and taken out of the box body;

a first connection piece which is integrally and continuously connected to one side of the opening and which is folded toward an inner wall of the box body;

a partition plate which is integrally and continuously connected to the first connection piece and which partitions an accommodation space surrounded by the box body into an upper first accommodation portion and a lower second accommodation portion when the partition plate is folded into the box body;

a second connection piece integrally and continuously connected to the other side of the opening which is substantially perpendicular to the one side;

a held plate which is integrally and continuously connected to the second connection piece and which is folded toward the inside of the box body such that the first accommodation portion is formed with a third accommodation portion; and an unfolding preventing portion which is provided on an edge of the first connection piece nearest to the second connection piece, and which prevents the held plate folded toward the inside of the box body from unfolding open, wherein the unfolding preventing portion includes an insertion piece projecting from an edge of the held plate, a first engaging portion which is formed on the first connection piece to engage with a side of the held plate, the side being formed by bending the held plate and the insertion piece, and a second engaging portion which is formed on the first connection piece and which engages with an upper side of the insertion piece when the held plate is folded toward the inside of the box body.

16. The package box according to claim 15, wherein the first connection piece is formed in a substantial L-shape having a portion whose width is narrower than a portion which is integrally and continuously connected to the one side of the opening.

* * * * *